United States Patent [19]

Keller

[11] Patent Number: 4,926,641

[45] Date of Patent: May 22, 1990

[54] TURBOCHARGER LUBRICATION SYSTEM

[76] Inventor: Robert A. Keller, 1604 Camberwell Pl., Westlake Village, Calif. 91361

[21] Appl. No.: 296,186

[22] Filed: Jan. 11, 1989

[51] Int. Cl.[5] ..... F01M 11/04; F02B 37/00

[52] U.S. Cl. ..... 60/605.3; 184/6.13

[58] Field of Search ..... 60/605.3; 184/6.11, 184/6.13; 417/407

[56] References Cited

U.S. PATENT DOCUMENTS

| | | | |
|---|---|---|---|
| 2,370,581 | 2/1945 | Reed | 184/6.13 X |
| 2,460,283 | 2/1949 | Gooch | 184/6.13 |
| 3,618,710 | 11/1971 | De Lisse et al. | 184/6.11 |
| 3,740,170 | 6/1973 | Miller | 417/407 |
| 4,009,972 | 3/1977 | Sarle | 417/407 |
| 4,511,016 | 4/1985 | Doell | 184/6.11 |
| 4,525,995 | 7/1985 | Clark | 60/39.08 |
| 4,752,193 | 6/1988 | Horler | 417/407 |

FOREIGN PATENT DOCUMENTS

| | | | |
|---|---|---|---|
| 135325 | 8/1983 | Japan | 60/605.3 |

*Primary Examiner*—Michael Koczo

*Attorney, Agent, or Firm*—Stetina and Brunda

[57] ABSTRACT

A lubrication system for a turbocharger utilized on an internal combustion engine is disclosed characterized by use of a fluidic motor/pump assembly driven by oil pressure derived from the existing oil pump of the internal combustion engine to simultaneously provide pressurized oil supply and vacuum oil drain from the turbocharger.

15 Claims, 1 Drawing Sheet

Fig. 1
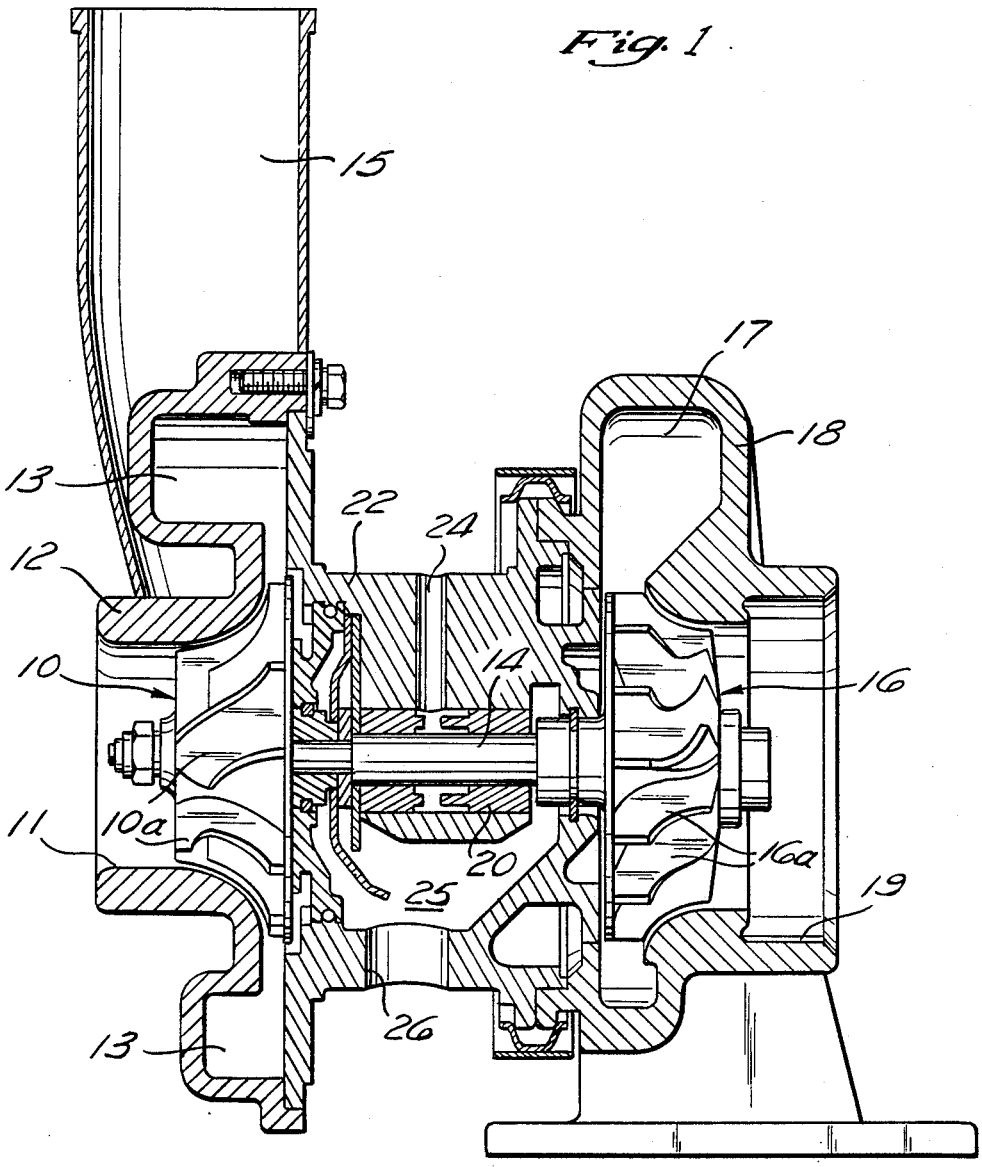
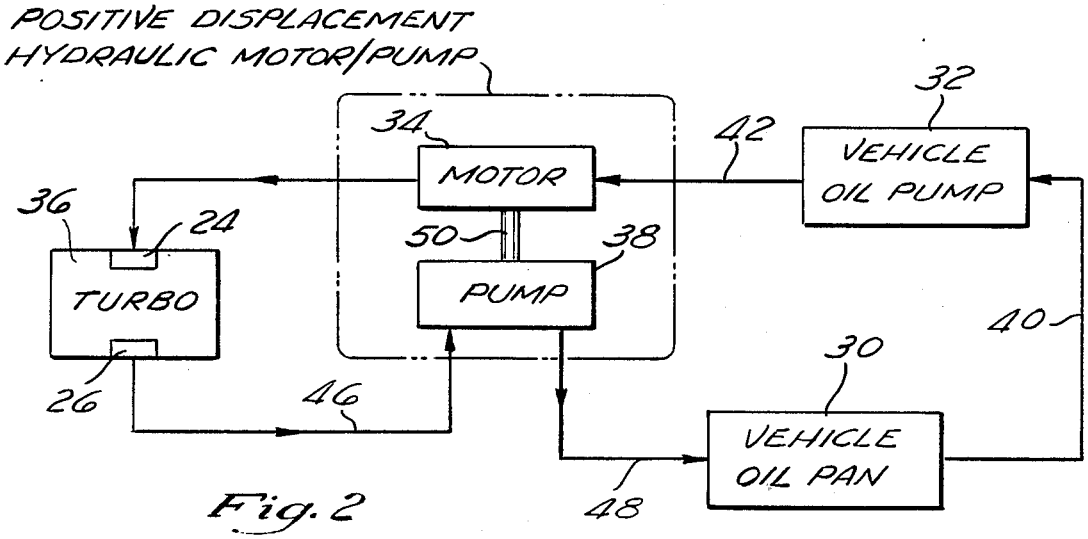
Fig. 2

TURBOCHARGER LUBRICATION SYSTEM

BACKGROUND OF THE INVENTION

The present invention relates generally to exhaust-gas turbochargers for internal combustion engines, and more particularly to an inexpensive apparatus and associated method to prevent undesired backup of lubricating oil into the turbine wheel housing formed on the hot side of a turbocharger.

As is well known, exhaust-gas turbochargers are utilized on a large number of internal combustion engines to increase peak horsepower and performance. Nearly all of such conventional turbochargers utilize a lubrication system wherein oil is supplied under pressure to the turbine bearing housing through an inlet port into the interior of the turbocharger and subsequently ported through internal flow channels to lubricate the bearings of the turbocharger shaft. Subsequently, a common outlet or drain is provided at the lower most portion of the turbocharger housing, wherein the oil drains by gravity to an oil sump. In view of the high temperatures and pressures encountered in operation of the turbocharger, the oil lubricant typically is discharged adjacent the outlet port in an aerated or foamed condition and as such, there is a tendency for such foamed oil to backup adjacent the outlet port and occasionally seep or back flow into the interior of the turbine wheel housing formed on the hot side of the turbocharger. When such a back flow condition occurs, the turbine undesirably burns oil and/or throws oil during operation.

In recognition of the inherent deficiencies of such prior art lubrication systems, it has heretofore been customary to mount all turbochargers at the highest possible vertical elevation or location relative to the engine, sometimes requiring modification of the engine compartment cover or hood, such that oil discharged through the outlet port has a sufficiently long drain conduit to avoid excessive backup. With the ever shrinking room availability for engines within modern motor vehicle, boating and aviation applications, however, it is oftentimes difficult, if not impossible to mount turbochargers at a high enough elevation relative to the engine to completely avoid such oil backup.

It is additionally known in the prior art for racing applications, to utilize a dry-sump pump system which basically comprises an auxiliary pump being utilized to apply a vacuum to the oil outlet port of the turbocharger and pull the drain oil therefrom. However, such modern racing application systems are typically driven mechanically from power obtained from the cam shaft of the engine or through an auxiliary electric motor, both of which are subject to failure during prolonged use and are costly to install and maintain.

A variety of other prior art approaches have been applied to turbocharger lubrication. For example, in U.S. Letters Pat. No. 4,009,972 issued to Sarle, the turbocharger is modified such that an air pressure bleed from the turbocharger compressor is diverted to the turbocharger oil sump exhaust line to assist oil flow from the turbocharger by virtue of a pressure differential. Another approach disclosed in U.S. Pat. No. 3,740,170 issued to Miller, utilizes a separate gear pump to supply oil to the turbocharger inlet, while relying on gravity to return the oil from the turbocharger. In yet another approach, disclosed in U.S. Letters Pat. No. 4,752,193 issued to Horler, a separate gear or vane pump is utilized to supply lubricant to the inlet of the turbocharger while a low pressure boost air pipe is utilized to aid oil return. U.S. Letters Pat. No. 4,525,995 issued to Clark depicts a lubrication system specifically adapted to gas turbine engines wherein oil is scavenged from the turbocharger cavity by allowing high pressure air from the compressor section of the engine to leak into the cavity and then flow downwardly together with the entrained scavenged oil from the turbocharger. Yet another approach, disclosed in U.S. Letters Pat. No. 4,511,016 issued to Doell, also adapted to gas turbine engines, utilizes a primary and auxiliary lubricant circulating circuit to provide a lubricant supply to the engine lubricating chamber.

These prior art lubrication systems, however, either require the use of auxiliary equipment driven by the engine cam shaft or an auxiliary electric motor, and/or require modifications to the turbocharger itself, and/or simply rely on gravity for oil return, in which case the tendency for the turbocharger oil to backup continues to exist. Furthermore, as noted above, the auxiliary cam shaft or electric motor driven equipment used by some of these systems is costly to install as well as subject to failure during prolonged use. As such there exists a substantial need in the art for an improved turbocharger lubrication system which is low cost, reliable and eliminates the oil backup problems associated in the art.

SUMMARY OF THE INVENTION

The present invention specifically addresses and alleviates the above referenced deficiencies in the prior art by providing a positive displacement pump for oil supply and return to the turbocharger powered by input oil supplied from the existing oil pump in the engine itself. More specifically, an oil line from the existing oil pump of an internal combustion engine is utilized, i.e. branched, to power a hydraulic motor/pump assembly. The motor is preferrably formed as a positive displacement fluidic pump, such as a gear or vane pump, the output of which is communicated to the inlet lubrication port of the turbocharger. The motor drives a similarly formed gear pump via a common shaft, which serves to supply a positive vacuum at the oil outlet or outlet lubrication port of the turbocharger. The fluidic output from the pump is connected to the engine oil pan or collection reservoir. As such, the present invention utilizes hydraulic power from the existing internal combustion engine oil pump to provide pressurized inlet and vacuum outlet to the lubrication system of the turbocharger. Using such a procedure, the turbocharger can be installed at nearly any vertical location within the engine compartment that is available even vertically below the engine, and insure continued operation without oil backup.

BRIEF DESCRIPTION OF THE DRAWINGS

These, as well as other features, aspects, and advantages of the present invention, will become more apparent upon references to the drawings wherein:

FIG. 1 is a cross sectional view of a conventional single-stage exhaust-gas turbocharger for an internal combustion engine; and FIG. 2 is a schmatic flow diagram showing the present invention as applied to a turbocharger lubrication system.

DETAILED DESCRIPTION OF THE PREFERRED EMBODIMENT

Shown in FIG. 1 is a cross sectional view of a conventional single stage exhaust-gas turbocharger for an internal combustion engine (not shown). The turbocharger serves generally as a fluid-driven motor/pump set, with the exhaust turbine impeller 16, disposed in turbine housing 18, acting as a fluid motor driven by hot gases which pass from the engine exhaust manifold (not shown) through the annular turbine inlet chamber 17, then expand through the turbine impeller vanes 16A thereby driving the impeller 16, and finally exiting via the turbine outlet orifice 19. The turbine impeller 16 in turn drives the compressor impeller 10 disposed in compressor cover 12, via a common shaft 14. The common shaft 14 is rotatably mounted along the longitudinal axis of the turbocharger in a bearing assembly 20 which in turn is maintained in a bearing housing 22, located between the compressor cover 12 and the exhaust turbine housing 18. So driven, the compressor impeller 10 acts as a compressor and/or pump, drawing ambient air in from the compressor inlet orifice 11, through the compressor vanes 10A and into the annular compressor outlet chamber 13, with the air finally exiting via the compressor output conduit 15. The compressed air from the output conduit 15 is directed into the internal combustion engine intake manifold (not shown), and thereby is utilized to provide engine power boost, i.e. increased engine performance.

Turning now to the preferred application of the present invention, lubrication in the form of oil, is provided to lubricate the common shaft 14 and bearing assembly 20 of the turbocharger via an oil inlet port 24. Oil is returned to an oil collection reservoir or oil pan via the outlet collection chamber 25, which communicates with the outlet lubrication port 26, which in turn communicates with the oil collection reservoir via a sump line or oil exhaust line. As mentioned in the preceeding background, because of the high temperatures and pressures encountered in the turbocharger, oil is typically discharged through the outlet port 26 in an aerated or foamed condition. The oil in this condition tends to build up in the outlet collection chamber 25 and, consequently, occasionally seeps or back flows into the high temperature region of the turbocharger formed by the exhaust impeller housing 18, resulting in smoking and other undesirable consequences. As explained in more detail in the description that follows, the present invention specifically alleviates this oil backup problem by providing a pressurized inlet oil supply to the oil inlet port 24, and a positive vacuum at the oil outlet port 26 of the turbocharger by way of power supplied by the existing oil pump of the engine. As such, improved lubrication of the turbocharger is facilitated via existing power which heretofore was not utilized for such purpose.

The apparatus and operation of the present invention is best described with reference to the schematic diagram of FIG. 2 which depicts the improved internal combustion engine/turbocharger lubrication circuit of the present invention. The present invention generally comprises use of the existing engine oil collection reservoir or pan 30, and existing engine oil pump 32, a conventional positive displacement hydraulic motor 34 and pump 38 and a conventional turbocharger 36. The outlet of the oil collection reservoir 30 is fluidically connected to the inlet of the engine oil pump 32 via an oil pump inlet line 40, while the outlet of the existing engine oil pump 32 is split or branched to simultaneously supply oil to the existing engine lubrication system as well as be fluidically connected to the input of the hydraulic motor 34 via an oil pump outlet line 42. The outlet of the hydraulic motor 34 is fluidically connected to the oil inlet port 24 of the turbocharger via a turbocharger inlet line 44. The turbocharger oil outlet port is fluidically connected to the inlet of the hydraulic pump 38 via the oil exhaust line 46. Finally, the outlet of the hydraulic pump 38 is fluidically connected to the inlet of the collection reservoir 30 via the reservoir return line 48.

With the structure defined, the operation of the turbocharger lubrication circuit of the present invention may be described. Operation of the internal combustion engine powers the existing engine oil pump 32 of the internal combustion engine in a conventional manner to establish a positive vacuum in oil pump inlet line 40, causing oil to flow therethrough from the collection reservoir 30 and into the oil pump 32. The outlet from the oil pump 32 typically ranges from 40 to 60 pounds per square inch (psi) and is supplied to the engine lubrication system in a conventional manner as well as to the hydraulic motor 34 via the oil pump outlet line 42. The positive pressure oil flow from the outlet line 42 drives the positive displacement hydraulic motor 34, which is rotatably coupled to the positive displacement hydraulic pump 38 by a common shaft 50, causing the motor 34 to in turn fluidically drive the pump 38. The outlet oil from the hydraulic motor 34, typically having a pressure ranging from 35 to 55 psi passes through the turbocharger inlet line 44 and into the turbocharger oil inlet port 24. The positive displacement output of the hydraulic motor 34 establishes a positive pressure oil flow in inlet line 44, and thereby provides a positive pressure oil supply to the turbocharger oil inlet port 24.

The positive displacement hydraulic pump 38, driven by the hydraulic motor 34 simultaneously establishes a vacuum in oil exhaust line 46 and consequently in the turbocharger oil outlet port 26, causing the inlet oil to the turbocharger to be drawn through the exhaust line 46 and into the hydraulic pump 38. Discharge oil from the pump 38 is then returned via the reservoir return line 48 into the collection reservoir 30.

From the above description, it will be recognized that the present invention provides a pressurized lubricating oil supply and vacuum outlet to the turbocharger via power derived from the existing oil pump 32 of an internal combustion engine. As such, heretofore non-utilized or spent power from the existing oil pump 32 is effectively utilized to eliminate possible lubrication backup conditions existing within the turbocharger. Thus, by way of the present invention, the turbocharger may be mounted at any location relative the engine without the possibility of lubricating oil backup and without the use of costly, failure prone auxiliary cam-shaft or electric motor driven pumps being utilized.

As will be recognized, the utilization of the existing power from the oil pump 32 of an internal combustion engine via the hydraulic motor 34 and pump 38 arrangement of the present invention enables numerous modifications to existing turbocharger lubrication circuits. For instance, the hydraulic pump 38 may be utilized in conventional dry-sump pump applications to supply and return lubricating oil to the turbocharger without the use of auxiliary cam-shaft driven or electric motor driven pumps. In such modification, the outlet from the motor 34 may be returned directly to the oil pan 30 whereby two parallel oil flow systems are formed; the first being from the existing oil pump 32 to the motor 34 and into the oil pan 30 and the second being from the pump 38 to the turbocharger and into the pan 30.

As is evident from the foregoing discussion, the present invention establishes a positive pressure oil supply to the turbocharger oil inlet port, while also establishing a positive vacuum at the turbocharger outlet port and thereby serves to inhibit undesired oil back flow into the hot side of the turbocharger, without the need for modifications to the turbocharger or the use of costly and failure-prone auxiliary pumps powered from the engine cam shaft or auxiliary electric motors.

It will be understood that while the hydraulic motor/pump assembly of the present invention preferrably consists of a gear motor and gear pump, respectively, any other suitable type of positive displacement hydraulic motor/pumps could be used within the scope of the present invention. It should be further understood that other variations of the embodiments disclosed are possible without departing from the scope of the present invention.

What is claimed is:

1. In an internal combustion engine having an oil pump for lubricating said engine and a turbocharger for increasing engine performance, the turbocharger having an oil inlet port and an oil outlet port, a lubrication system for supplying and removing lubricating oil to the turbocharger comprising:

motor means fluidically coupled to and driven by said oil pump of the internal combustion engine for supplying positive pressure oil flow to the oil inlet port of said turbocharger; and pump means mechanically coupled to and driven by said motor means for providing a positive vacuum oil flow from the oil outlet port of said turbocharger.

2. The lubrication system of claim 1 wherein said motor means comprises a hydraulic motor having an outlet port and an inlet port, said inlet port fluidically coupled to the outlet port of said oil pump, and said outlet port fluidically coupled to the oil inlet of said turbocharger.

3. The lubrication system of claim 2 wherein said pump means comprises a hydraulic pump, mechanically coupled to and driven by said hydraulic motor, having an outlet port and an inlet port, said inlet port fluidically coupled to the oil outlet port of said turbocharger.

4. The lubrication system of claim 3 wherein said hydraulic pump is mechanically coupled to said hydraulic motor by a common shaft.

5. The lubrication system of claim 4 wherein said hydraulic motor comprises a positive displacement hydraulic motor.

6. The lubrication system of claim 5 wherein said hydraulic pump comprises a positive displacement hydraulic pump.

7. The lubrication system of claim 5 wherein said positive displacement hydraulic motor comprises a gear motor.

8. The lubrication systems of claim 6 wherein said positive displacement hydraulic pump comprises a gear pump.

9. A lubrication system for supplying lubricating oil to an internal combustion engine turbocharger comprising:

an oil collection reservoir having an inlet port and an outlet port;

an engine oil pump having an outlet port and an inlet port, said inlet port fluidically coupled to said outlet port of said oil collection reservoir, thereby enabling oil to flow from said oil collection reservoir into said oil pump;

a hydraulic motor having an outlet port and an inlet port, said inlet port fluidically coupled to said outlet port of said oil pump, thereby enabling oil to flow under positive pressure from said oil pump into said hydraulic motor and drive said hydraulic motor;

a turbocharger having an oil outlet port and an oil inlet port, said oil inlet port fluidically coupled to said outlet port of said hydraulic motor, thereby enabling oil to flow under positive pressure from said hydraulic motor into said turbocharger; and a hydraulic pump, mechanically coupled to and driven by said hydraulic motor, having an outlet port and an inlet port, said inlet port fluidically coupled to said oil outlet port of said turbocharger, whereby said hydraulic pump is driven by said hydraulic motor, thereby causing oil to flow under positive vacuum from said turbocharger oil outlet port into said hydraulic pump, and further with said outlet port of said hydraulic pump fluidically coupled to said inlet port of said oil collection reservoir, thereby enabling oil to flow from said hydraulic pump into said oil collection reservoir.

10. The lubrication system of claim 9 wherein said hydraulic motor is a positive displacement hydraulic motor.

11. The lubrication system of claim 10 wherein said hydraulic pump is a positive displacement hydraulic pump.

12. The lubrication system of claim 10 wherein said positive displacement hydraulic motor comprises a gear motor.

13. The lubrication system of claim 11 wherein said positive displacement hydraulic pump comprises a gear pump.

14. The lubrication system of claim 10 wherein said positive displacement hydraulic motor comprises a vane motor.

15. The lubrication system of claim 11 wherein said positive displacement hydraulic pump comprises a vane pump.

* * * * *